United States Patent [19]

Pavek et al.

[11] Patent Number: 4,498,280

[45] Date of Patent: Feb. 12, 1985

[54] METHOD OF AND APPARATUS FOR PREPARING AND SPLICING THE ENDS OF FIBROUS FORMATIONS

[75] Inventors: Miloslav Pavek; Ladislav Hlubucek, both of Liberec, Czechoslovakia

[73] Assignee: ELITEX, koncern textilniho strojirenstvi, Liberec, Czechoslovakia

[21] Appl. No.: 569,392

[22] Filed: Jan. 9, 1984

[30] Foreign Application Priority Data

Jan. 7, 1983 [CS] Czechoslovakia ..... 127-83

[51] Int. Cl.[3] ..... D01H 15/00

[52] U.S. Cl. ..... 57/22

[58] Field of Search ..... 57/22, 23, 261, 350, 57/351, 908

[56] References Cited

U.S. PATENT DOCUMENTS 4,419,859 12/1983 Mima ..... 57/22
4,432,194 2/1984 Luz ..... 57/22
4,452,035 6/1984 Rohner et al. ..... 57/22

FOREIGN PATENT DOCUMENTS 145075 11/1981 Japan ..... 57/22
956992 4/1964 United Kingdom ..... 57/22

*Primary Examiner*—Donald Watkins

[57] ABSTRACT

Method of and apparatus for preparing and splicing the ends of fibrous formations, particularly in the pressure channel of a pneumatic splicing chamber provided with a displaceable lid. Excess lengths of ends of fibrous formations to be spliced are placed within the pressure channel in overlapping substantially parallel relationship and are then cut to a desired length by cutting means such as scissors. Following such cutting operation, the fibrous formations within the pressure channel are bent without gripping over the edges of the mouth of the pressure channel, whereby to hold the sections of the fibrous formations within the channel in generally parallel relationship. Following this, the thus held sections of the fibrous formations within the pressure air channel are subjected to the whirling effect of a pressure air flow introduced centrally into the pressure channel, such flow dividing to flow outwardly through respective mouths at the ends of the pressure channel, such air flows impinging upon adjustable obstacles provided with blades whereby to subject the air flows to high frequency vibration.

6 Claims, 2 Drawing Figures

Figure 1:
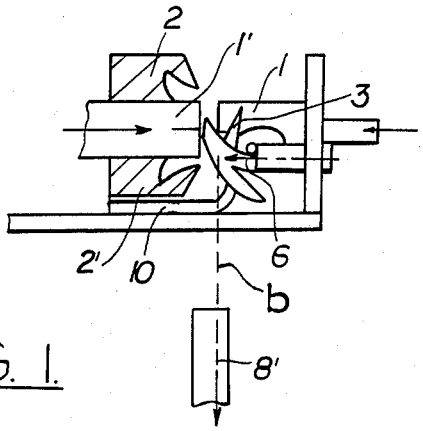

METHOD OF AND APPARATUS FOR PREPARING AND SPLICING THE ENDS OF FIBROUS FORMATIONS

This application is related to the co-assigned application of Pavek Ser. No. 569,391 filed Jan. 9, 1984.

The present invention relates to a method of and an apparatus for preparing and splicing the ends of fibrous formations. The invention is applicable with particular advantage to the splicing of fibrous formations in the pressure channel of a splicing chamber provided with a displaceable lid for the pressure channel. In thus splicing fibrous formations, the ends of the fibrous formations to be spliced are situated in overlapping generally parallel relationship, and are subjected to the whirling effect of pressure air until their separate fibers are mutually spliced and form a knotless connection.

It has been hitherto known to form a spliced connection between fibrous formations by pneumatic means. The spliced connections thus-formed are of variable strength and in many cases contain unspliced fiber ends. This causes difficulties in the succeeding technological processing of fibrous formations which have been spliced by pneumatic means.

These undesired results in spliced connections occur for a great number of reasons. One of the most important of such reasons is the fact that the ends of the fibrous formations which are introduced into the splicing chamber are frequently blown out of the pressure channel of the splicing chamber immediately before splicing. For this reason, the splicing procedure sometimes has to be repeated several times.

In order to avoid this undesired phenomenon, the devices for splicing fibrous formations hitherto known are equipped with very complicated fibrous formation retaining mechanisms at the sides of the splicing chamber, the retaining means functioning either mechanically or pneumatically. However, the disadvantage of such arrangements consists in that the retained ends do not participate in the splicing procedure with the other parts of the fibrous formations. Thereupon, a spliced connection is formed which after its finishing has two short, projecting unspliced ends and which is thus not compact.

The above disadvantage of the prior art substantially mitigated by the method of and apparatus for preparing and splicing the ends of fibrous formations according to the present invention. In accordance with the invention, the ends of the fibrous formations, which are trimmed by scissors or the like, are bent without gripping by adjustable obstacles with blades over the ends of the pressure channel mouth or mouths, together with the parallel sections of the fibrous formations.

It is particularly advantageous according to the present invention when the fibrous formations are separately retained at their inlet side into the pressure channel of the splicing chamber, apart from their sections bent over the edges of the pressure channel mouth.

In order to achieve a reliable bending of the fibrous formations over the edges of the pressure channel mouth, the adjustable obstacles provided with blades are formed, according to the present invention, in the shape of a ring surrounding either the lid of the pressure channel or the body of the splicing chamber which is provided with the pressure channel.

The blades on the obstacles are formed in various manners, e.g. a plane knife made of sheet metal, which is mounted inclined relative to the mouth of the pressure channel.

The effects of the present invention are based, above all, on the fact that, upon closing the pressure channel of the splicing chamber, the fibrous formations introduced thereinto are not blown out in an undesired manner. Thus, the splicing operation need not be repeated, and the introduced sections of the fibrous formations participate along their whole length, after appropriate trimming of their ends, in the splicing procedure, thus forming a highly compact spliced connection without any projecting short ends, such spliced connections possessing good tensile strength.

Figure 2:
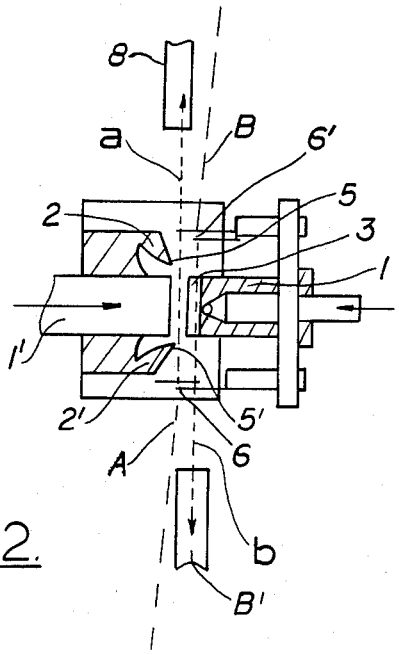

Further effects and features of the present invention are described in the following specification of an exemplary embodiment of the splicing method and an exemplary embodiment of the apparatus of the invention, and the accompanying drawing, in which:

FIG. 1 is a diagrammatic view in side elevation of the splicing chamber of the apparatus with the obstacle blades fastened on the lid thereof and with the lid raised, and FIG. 2 is a plan view of the splicing unit, such figure further illustrating the means for cutting off the ends of the fibrous formations and for the withdrawing of the cut-off ends thereof.

Fibrous formations A, B (FIG. 2) are introduced into the splicing chamber in a suitable manner as by use of a fibrous formation feeding means (not shown) with the pressure channel 3 of the splicing chamber 1 being in open position by reason of the raising of a displaceable lid 1' for the splicing chamber. After the introduction of the fibrous formations A, B into the pressure channel, inside which the said formations are disposed in overlapping generally parallel position adjacent to each other, the pressure channel 3 is closed by lowering the lid 1'. Scissors 6, 6' cut off, or shorten, the respective fibrous formations A, B by the operation of lever 10 which operates the scissors. The cut off ends a, b of the fibrous formations A, B, respectively, are sucked into respective outlets 8, 8' provided with sub-atmospheric pressure, or are removed in other suitable manners from the vicinity of the splicing chamber 1.

The blades 5, 5' of obstacles 2, 2', in the exemplary embodiment shown in FIG. 2 are mounted on the lid 1' of splicing chamber 1. The closing of the lid 1', blades 5, 5' simultaneously disposes in front of the respective mouths of the pressure channel 3 and thus bend the remaining overlapping ends of the fibrous formations A, B over the edges of the mouth of the pressure channel 3, whereby to retain the intermediate sections of the fibrous formations parallel to each other without any gripping thereof. This means, that relative to the location of the scissors 6, 6' in the immediate proximity of obstacles 2, 2', the blades 5, 5' of obstacles 2, 2' bend very short cut ends of the fibrous formations A, B which can freely participate in the splicing operation since they are not gripped by anything, while maintaining the ungripped intermediate sections of the fibrous formations parallel to each other, thus making very compact the eventual connection of splicing which will be formed.

In order to reinforce the above-described effects, and to exclude any possibility of the undesired blowing out of one or the other of the trimmed ends of fibrous formations A, B, it is recommended in the practice of the present invention that the separate fibrous formations A, B be retained at the sides of their respective introductions into the pressure channel 3 of the splicing chamber 1 by suitable gripper mechanisms (not shown).

As far as the situation at each closing of the splicing chamber 1 is concerned, at which the relations between cooperating fibrous formation components must be absolutely consistent every time, it is adequate, according to the present invention, to fasten the adjustable obstacles 2, 2' on lid 1'. It is particularly advantageous, when the adjustable obstacles 2, 2' with blades 5, 5' are made in the form of a ring, which surrounds the lid 1' of the pressure channel 3. This means that the lid 1' is circular or cylindrical, respectively, and that the splicing chamber 1 is also circular or cylindrical. With any turning of the lid 1' about its longitudinal axis, the conditions remain unchanged.

The ring with blades 5, 5', or only with a single round blade 5, can also be arranged on the body of the splicing chamber 1. Blades 5, 5' can also be made of components which are shaped in other manners, e.g. planar knives which are directed inclined (not shown) toward the mouth or mouths of the pressure channel 3 of the splicing chamber 1, or the like.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Method of preparing and splicing the ends of fibrous formations in the pressure channel of a pneumatic splicing chamber provided with a displaceable lid, comprising placing ends of excess length of the fibrous formations in overlapping substantially parallel relationship adjacent to each other within the pressure channel, cutting off the excess length at each end of each of the fibrous formations when they are positioned within the pressure channel, after such trimming of the fibrous formations bending the remaining ends thereof without gripping by adjustable obstacles with blades over the edges of the mouth of the pressure channel, whereby to retain the fibrous formations in generally parallel relationship in the pressure channel of the splicing chamber, and subjecting the thus positioned fibrous formations to the whirling effect of a pressure air flow which is introduced centrally into the pressure channel and flows outwardly therefrom in opposite directions through the mouths of the channel, upon leaving the mouth of the pressure channel the pressure flow impinging upon adjustable obstacles provided with blades.

2. A method as claimed in claim 1, wherein the fibrous formations are each retained separately, beside their sections bent over the edges of the pressure channel mouth, at the respective side of their introduction into the pressure channel of the splicing chamber.

3. Apparatus for preparing and splicing the ends of fibrous formations disposed in the pressure channel of a pneumatic splicing chamber provided with a displaceable lid for the pressure channel, comprising means for cutting off excess length of fibrous formations disposed side-by-side in the pressure channel, said pressure chamber being provided with adjustable obstacles provided with blades, said blades confronting the respective ends of the pressure channel when the channel is closed by the lid.

4. Apparatus according to claim 3, wherein the adjustable obstacles are provided with blades being made in the form of a ring surrounding the lid of the pressure channel.

5. Apparatus as claimed in claim 3, wherein the adjustable obstacles surround the body of the splicing chamber and confront the respective ends of the pressure channel therein.

6. Apparatus as claimed in claim 5, wherein each of the adjustable obstacles provided with blades is formed by a planar knife, which is directed inclined relative to the respective mouth of the pressure channel.

* * * * *